United States Patent [19]

Sanders et al.

[11] Patent Number: 4,693,541

[45] Date of Patent: Sep. 15, 1987

[54] ELECTRICAL ORNAMENTATION SYSTEM

[75] Inventors: Robert E. Sanders, Lenexa, Kans.; Jerry L. Knipp, Grandview; Charles J. Flynn, Kansas City, both of Mo.

[73] Assignee: Hallmark Cards, Inc., Kansas City, Mo.

[21] Appl. No.: 747,647

[22] Filed: Jun. 21, 1985

Related U.S. Application Data

[63] Continuation-in-part of Ser. No. 508,522, Jun. 27, 1983, Pat. No. 4,544,218.

[51] Int. Cl.[4] ..... H01R 13/60

[52] U.S. Cl. ..... 439/541; 165/80 R; 439/558

[58] Field of Search ..... 339/112 R, 119 L, 125 L, 339/126 R, 126 RS, 128, 157 R, 157 C, 129, 176 L, 155 L, 177 L, 184 L, 191 L, 195 L; 165/80 R, 80 A; 362/806-809, 365-368, 373, 370

[56] References Cited

U.S. PATENT DOCUMENTS

| | | | |
|---|---|---|---|
| 2,090,118 | 8/1937 | Graf | 362/807 |
| 2,248,117 | 7/1941 | Petry | 367/807 |
| 2,660,661 | 11/1953 | Dupler | 362/809 |
| 3,217,319 | 11/1965 | Rueger | 339/126 R |
| 3,476,928 | 11/1969 | Greasley | 339/126 R |
| 4,220,808 | 9/1980 | Fiyita | 339/128 |
| 4,385,346 | 5/1983 | Spicer | 362/806 |
| 4,544,218 | 10/1985 | Sanders et al. | 339/157 C |

*Primary Examiner*—Gil Weidenfeld
*Assistant Examiner*—David Pirlot
*Attorney, Agent, or Firm*—Neuman, Williams, Anderson & Olson

[57] ABSTRACT

A connector is disclosed which permits an electrically illuminated ornament or the like to be readily connected to a string of conventional light sockets. A first connection is provided which preferably is in the form of a conventional socket for receiving a lamp which is inserted in a grommet carried by an ornament. At the opposite end, contacts are mounted in a support member of insulating material to form a plug assembly arrangd to fit within a conventional socket. The construction is such as to accommodate various types and dimensions of sockets. A coupling element attaches the connector to the ornament and acts as both a retention device and as a heat sink for the miniature light, the coupling element having particular utility in an edge-lit ornament.

14 Claims, 15 Drawing Figures

ELECTRICAL ORNAMENTATION SYSTEM

RELATED APPLICATION

This application is a continuation-in-part of Sanders U.S. application Ser. No. 508,522 filed June 27, 1983 entitled "Electrical Ornamentation System" now U.S. Pat. No. 4,544,218, issued Oct. 1, 1985.

This invention relates to electrical ornamentation and more particularly to a system for electrical energization of ornamental elements for Christmas trees or the like. The invention permits ornaments to be readily and quickly installed and electrically connected to a string of conventional light sockets. It also facilitates mounting of an ornamental element at a desired location on a Christmas tree or other receiving structure. It additionally provides for safe and reliable operation and, at the same time, the components required are readily and economically manufacturable.

BACKGROUND OF THE INVENTION

Electrified Christmas tree ornamentation has heretofore been available in a wide variety of styles, shapes and sizes. Lights, hanging ornaments of all types and tree-top decorations have been a part of holiday decorations throughout the centuries. Typically, the lights are placed on a tree in long strands supplied from a common electrical source. The ornaments are then hung separately at random locations around the tree.

More recently, techniques have been devised for combining the functions of lights and ornaments. An early example of this are the so-called "bubble lights" which became popular in the late '40's and early '50's. Other proposals have been made for adding decoration to conventional light strings for holiday decorating purposes. The Pacini U.S. Pat. No. 3,214,579, for example, discloses a system in which a central trunk line extends up the trunk of the tree and has a plurality of outlets therein into which electrical lights may be separately plugged. These lights may or may not have additional ornamentation.

A form of lighting that has become particularly popular in recent years involves use of the so-called "miniature" lights, wherein a series of small, low voltage lights of the incandescent type are strung in series around the tree. In lighting sets of this type, the electrical supply does not lie adjacent the trunk of the tree, but rather extends around the outer tips of the branches of the tree in the same region in which the lights are resting. Accessories to enhance the appearance and illumination of these miniature lamps have been marketed in the form of stars, leaves or the like which are designed to surround a lamp to be otherwise physically connected thereto.

SUMMARY OF THE INVENTION

This invention was evolved with the general object of providing improved systems and devices for ornamentation of Christmas trees and the like.

An important aspect of the invention relates to the recognition of the problems with prior art arrangements and in the discovery of sources of such problems. One of the problems with prior art systems using conventional strings of lights is that it is difficult to physically couple the light to an ornament and at the same time position the ornament in a desired location. Usually, it is necessary to make many adjustments in the position of the string of lights and in the position of the ornament in order to obtain a reasonably satisfactory result.

With the proposed arrangements involving the use of a central trunk line or the like, there are other problems. One important problem is that such systems are expensive and are not compatible with the conventional type of system in which lights are in a string, interconnected by flexible conductors.

Another problem is that with a central trunk line arrangement, there may be a great variation in distances between the trunk line and the desired position of a light or of an ornament.

In accordance with this invention, an arrangement is provided which preserves all of the advantages of the conventional string light systems including the ready availability and relative low cost of such systems. At the same time, the arrangement of the invention permits an ornamental element or the like to be readily connected for supply of electrical current thereto and to be physically mounted in a desired location. The arrangement is very simple, involving the use of a connector which can be readily and economically manufactured.

In accordance with an important feature of the invention, a connector is provided which includes an elongated flexible cable, first connection means being provided at one end to connect to an electrically energizeable element such as a light for energizing a Christmas tree ornament. At an opposite end, second connection means are provided for connection to contacts of a conventional socket. Preferably, and in accordance with a specific feature, the second connection means includes a member of insulating material and contacts mounted thereon to form a plug assembly which fits within the hollow housing of a conventional socket.

The cable of the connector preferably includes a twisted pair of conductors with a length of on the order of six inches, for example, to provide a "pigtail" appearance. With such a "pigtail" connector, ornaments may be mounted in any desired location on the Christmas tree. At the same time, electrical connections can be readily made from a string of conventional sockets on the tree, simply by inserting the plug assembly into the closest socket, after removing a light from the closest socket, if necessary.

In accordance with another specific feature, the connection means at the ornament end of the connector may preferably comprise a socket of conventional form, arranged for receiving a conventional type of light. This arrangement is particularly advantageous in that it permits use of the connector for a wide variety of applications. When desired, a plurality of the connectors may be connected in end-to-end relation, to provide an increased length, as when the ornament to be energized is at a greater than usual distance from the nearest socket of a string.

A further feature relates to the provision of means for physically coupling the lamp assembly to the ornament. U.S. application Ser. No. 508,522 discloses a resilient grommet arranged to receive and surround the cylindrical glass portion of a conventional miniature lamp. An alternative and preferred arrangement entails the use of a metallic coupling, preferably of brass or the like, which is adapted to surround the light and act as a clamp for the light socket and as a heat sink for the light itself. This arrangement is particularly useful for ornaments wherein the air space for the lamp is confined, as exemplified by an edge-lit transparent ornament disclosed below. In either case, the ornament may be supported through the connector alone or, in the case of heavier ornaments, hangers or other additional support means may be employed.

Additional important features of the invention relate to the construction of the plug assembly. Preferably, the plug assembly includes a member having a reduced diameter and portion and a pair of parallel passages extending to a terminal end thereof, with a pair of elongated contacts mounted in such passages and bent back on the outside. The diameter of the end portion is preferably small enough for the end portion to be inserted into the base portion of a conventional light with the contacts extending through openings in an end wall of the conventional light to be bent back on the outside thereof. This feature is important in that it facilitates use of the connector with different sizes and configurations of sockets. To accommodate sockets designed for lamp base portions of larger sizes, the end portion of the plug member preferably is of stepped configuration with a rearward portion of larger diameter for securely fitting into the inside of a lamp base which has a larger size.

This invention contemplates other objects, features and advantages which will become more fully apparent from the following detailed description taken in conjunction with the accompanying drawings.

DESCRIPTION OF A PREFERRED EMBODIMENT

Figure 1:
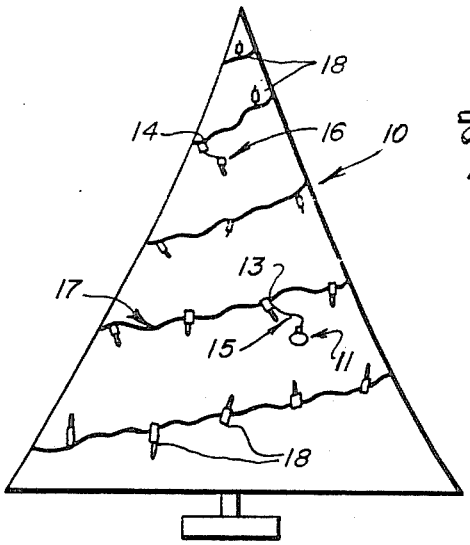
FIG. 1 diagrammatically illustrates a tree having lighted ornaments installed thereon in accordance with the invention.

Reference numeral 10 in FIG. 1 generally designates a tree having lighted ornaments 11 and 12 installed thereon in accordance with the invention. The ornaments 11 and 12 are connected to sockets 13 and 14 through a pair of connectors 15 and 16 constructed in accordance with the invention. The sockets 13 and 14 are in a conventional string of light sockets 17, shown wrapped around the tree 10 in conventional fashion, conventional lights 18 being mounted in other sockets of the string 17.

Figure 2:
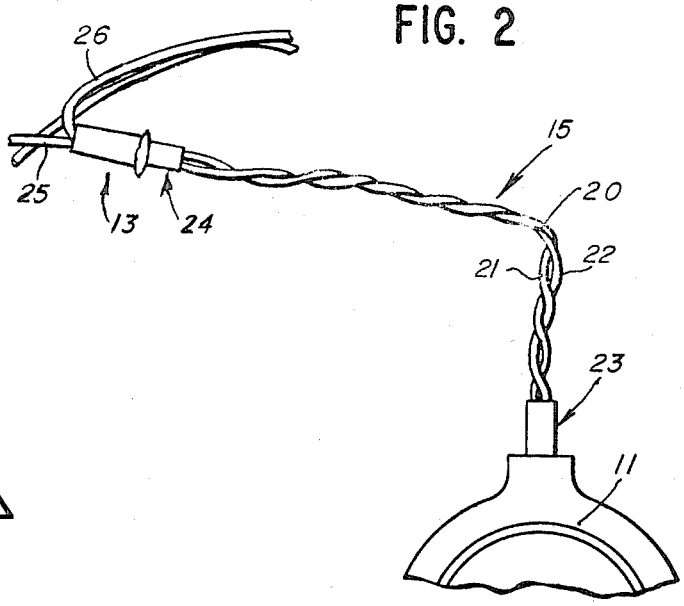
FIG. 2 illustrates the connection of one of the lighted ornaments to a string of light sockets, using a connector constructed in accordance with the invention.

As shown in FIG. 2, the connector 15 includes a flexible elongated cable 20 which, as shown, is formed by a twisted pair of conductors 21 and 22. A connector unit 23 is provided at one end of the cable 20 for connection to the ornament 11 and a connector unit 24 is provided at the opposite end of the cable 20 for connection to the socket 13, socket 13 being connected to conductors 25 and 26 of the light string 17.

The connector unit 23 in the illustrated embodiment has a construction like that of a conventional socket. It includes a hollow housing 28 of insulating material with a pair of contacts 29 and 30 mounted therein at diametrically opposed positions, such contacts 29 and 30 being connected to the cable conductors 21 and 22 which extend from one end of the housing 28. At the opposite end, the housing is arranged to receive a lamp base member 32 of insulating material which is hollow and which is arranged to receive an end portion of a lamp 33. The base member 32 includes a collar portion 34 which provides a shoulder arranged to abut the end of the connector housing 28. A pair of terminal wires 35 and 36 extend from the lamp and through the inner end of the base member 32. Such terminal wires 35 and 36 are bent back on the outside of the base member 32, to engage the contacts 29 and 30 when the lamp 33 together with the base member 32 are inserted into the connector housing 28. The base member 32 includes a spacer portion 38 which is disposed between the terminal wires 35 and 36 to prevent contact therebetween. In effect, the housing has an end wall with two spaced openings through which the wires 35 and 36 extend.

To connect to the ornament 11, the lamp 33 is inserted through a resilient grommet 39 which is installed in an opening in an inwardly projecting wall portion 40 of a neck portion of the ornament 11. Ornament 11 is hollow and may be transparent or translucent with suitable designs applied thereto or impressed in the material of the ornament. The terminal end of the neck portion has an opening 41 of larger size than the opening in the wall 40, with a diameter such as to limit tilting movement of the ornament 11 relative to the connector and lamp assembly. Preferably, the ornament 11 is formed in two parts which mate at a plane through the axis of the lamp and connector assembly and which are snapped together or otherwise secured together after installation of the grommet 39. The ornament 11 may, of course, include additional parts and may, for example, include front and rear lens elements which may be snapped into or otherwise secured to the aforementioned mating parts.

Figure 4:
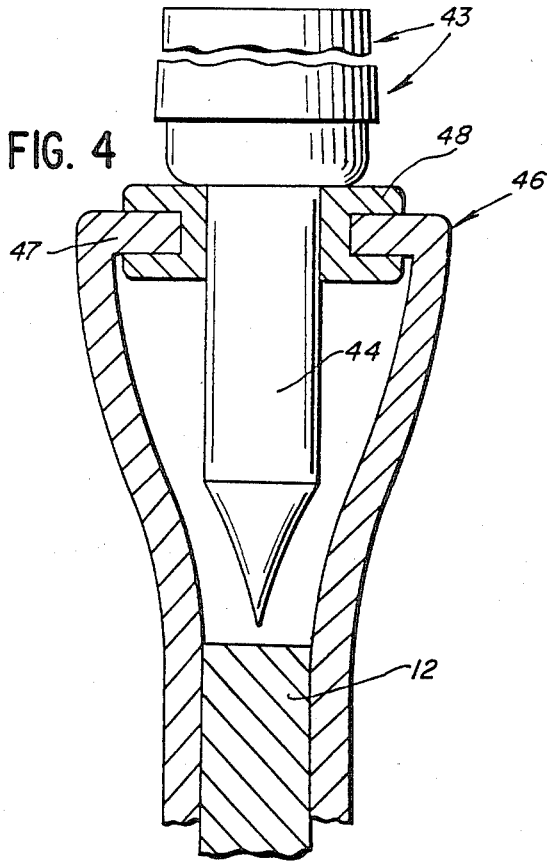
FIG. 4 is a view similar to FIG. 3 but illustrating the connection between a different type of ornament and a connector of the invention.

FIG. 4 shows the connection between the connector 16 and the ornament 12. The connector 16 is substantially identical to the connector 15 and at one end it has a connector unit which includes a socket 43 with a lamp 44 mounted therein by means of a base member 45. The ornament 12, as illustrated, is in the form of a plate which is preferably a clear transparent acrylic material, formed with a suitable design which may be etched therein with a metallic foil covering part of a back surface thereof. A generally bell-shaped metal fixture 46 is clamped onto an upper neck portion of the ornament 12 and it includes top wall portion 47 having an opening in which a resilient grommet 48 is mounted, to receive the lamp 44.

Figure 3:
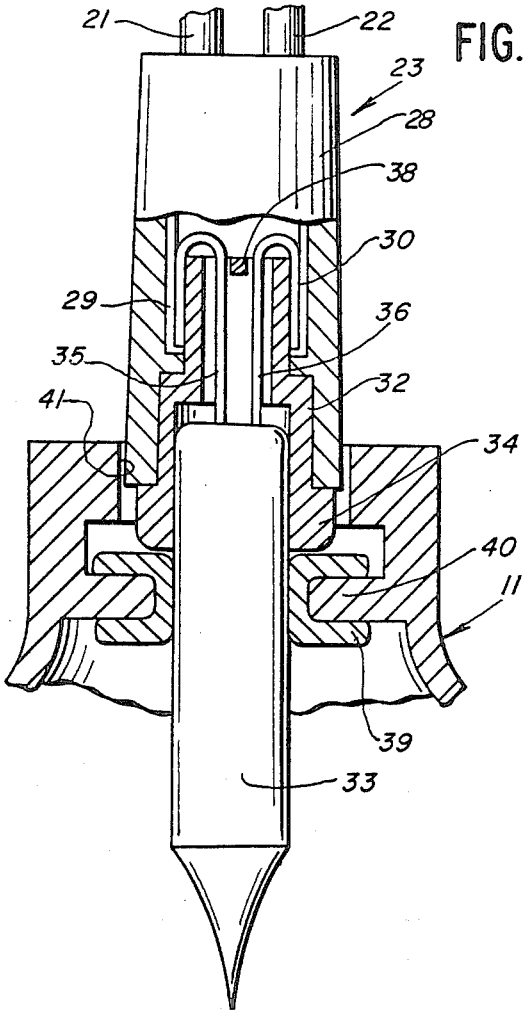
FIG. 3 is a sectional view taken substantially along line III—III of FIG. 2, illustrating the connection between the connector and the ornament.

The grommet 48, as well as the grommet 39, may be of a polypropylene material of a shape and size as generally disclosed in FIGS. 3 and 4. An alternative and preferred form of coupling element is disclosed in FIGS. 12–15 and discussed more fully below. In this form the coupling element is made of metal or other heat conductive material and acts as both a clamp for the light socket and as a heat sink for the light bulb itself.

Figure 12:
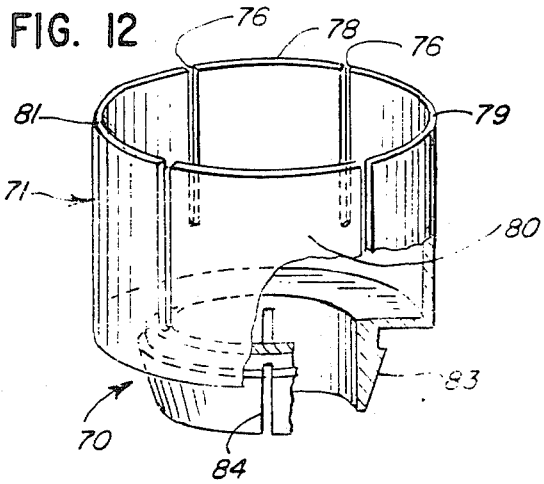
FIG. 12 is a perspective view of an alternative embodiment of the coupling element between the lamp socket and the ornament.
Figure 14:
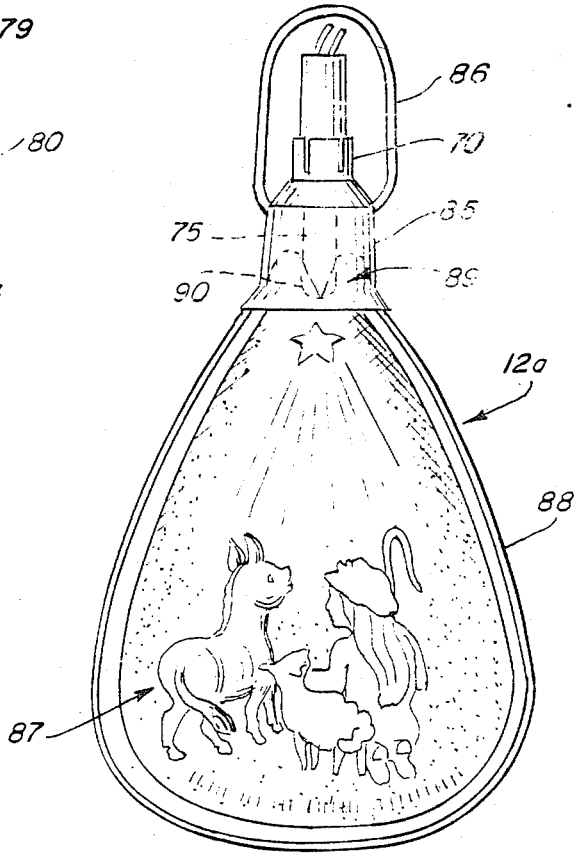
FIG. 14 is a plan view of the coupling element of FIG. 12 in combination with a decorative edge-lit ornament.
Figure 13:
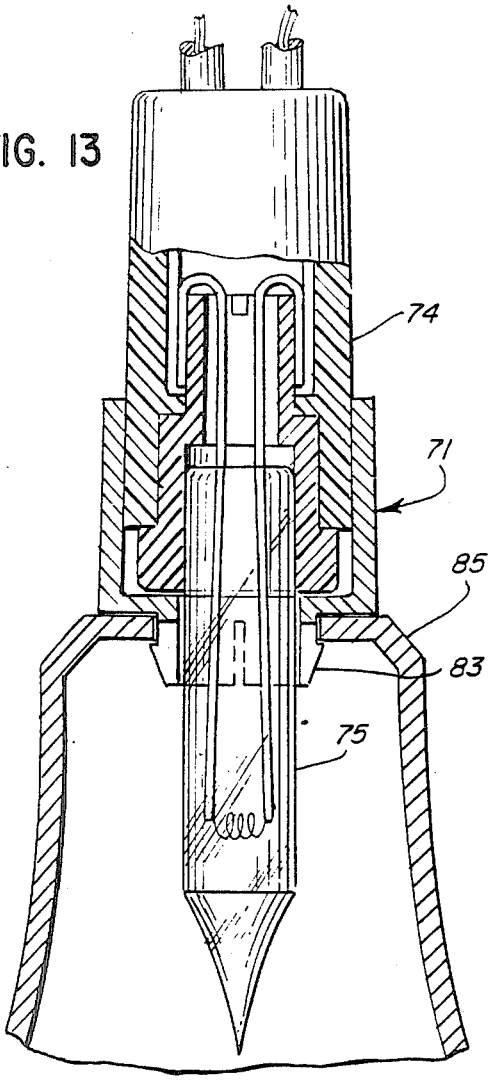
FIG. 13 is a cross-sectional view of the coupling element of FIG. 12 in combination with an ornament and socket assembly.

In either the embodiment of FIG. 4 or the embodiment of FIGS. 13 and 14 the light from the lamp 44 is projected downwardly into the transparent material of the ornament 12 to illuminate the design thereof. As such, the designs of these two embodiments employ the socalled edge-lit effect to produce a dramatic and unusual visual appearance. The metallic coupling element of FIG. 12 provides a further avantage in that it reflects, rather than absorbs, the light from the lamp filament so as to enhance the projection of light in the direction outward from the tip of the lamp, which greatly enhances the brightness of the edge-lit ornament with which coupling element and lamp are combined.

Turning more specifically to FIGS. 12–15, the coupling element 70 is disclosed as a composite structure having an outer portion 71 of generally cylindrical shape for clamping around the socket 74 of the light 75. The outer portion 71 has slots 76 formed therein and extending parallel to the axis of coupling element. The slots 76 allow for resilient expansion of the multiple portions 78, 79, 80 and 81 of the outer portion 71 so as to accept and grip the lamp socket 74. The slots terminate short of the bottom of the outer portion 71, thereby retaining a solid cylindrical surface area at the bottom of the portion 71 which serves as a tight clamp and provides for increasing clamping action by the portions 78, 79, 80 and 81 as the lamp socket 74 is pressed into the coupling element.

The coupling element 70 also has an inner or cylindrical portion 83 of metallic heat conductive material. The lower portion 83 may have slots 84 formed therein which cooperate with an outwardly projecting shoulder 82 to allow for a snap fit of the portion 83 into an aperture of the ornament crown element 85 (FIG. 13). The lower portion 83 closely surrounds the bulb 75 when the latter is inserted into the coupling element. As thus configured, the coupling element 70 acts as a heat sink by conducting the heat of the bulb 75 through the lower portion 83 and then to the larger upper portion 71. Heat reaching the portion 71 is carried away by normal convection air currents. Unlike rubber, polypropylene and other grommet materials, the metallic coupling element 70 will not expand, soften or melt from the heat of the bulb 75, and the lamp itself will burn cooler due to the avoidance of heat entrapment within the bulb.

FIG. 14 illustrates the use of the coupling element and light assembly in combination with an edge-lit acrylic or glass ornament similar to that shown in FIG. 4 and discussed above. The assembly includes a display portion 12*a* of glass, acrylic or the like, a dome-shaped crown element 85, typically of metal and having an ornamental handle 86, and the aforesaid coupling element 70. The display portion 12*a* has a design or scene 87 etched therein and has beveled edges 88 extending around the outer periphery. The beveled edges 88 are also etched so as to disperse the light entering from the top. At the top of the display portion 12*a* is an upwardly converging tip element 89 (shown in phantom lines) which is molded so as to nest within the dome-shaped crown element 85 and be secured therein through friction or with the aid of a suitable adhesive. A recessed area 90 is formed in the tip element 89 to receive the protruding bulb 75 and thereby accept light from the bulb to illuminate the display portion 12*a*. In accordance with known edge-lighting principles, the light is dispersed only in the etched portions 87 and 88 of the display portion 12*a*, making those portions appear illuminated to a much higher degree than the remainder of the display portion. The heat dissipating capabilities of the coupling element 70 are particularly well utilized in the ornament configuration of FIG. 14, where the air space for heat dissipation within the crown element 85 is minimal. Not only is heat able to escape through the coupling element 70 itself, but the coupling element 70 is additionally coupled thermally to the metal crown element 85 for further heat dissipation.

Figure 15:
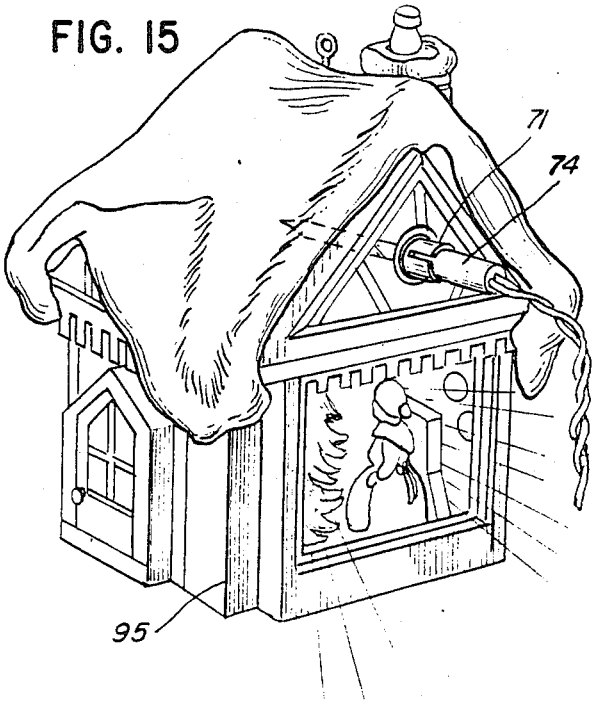
FIG. 15 is a perspective view of an alternate form of ornament for use with the connector element of FIG. 2 and the coupling element of FIG. 12.

A simplified use of the coupling element 70 is shown in FIG. 15, wherein it is coupled to an ornament in the shape of a snow-covered house 95 and facilitates the provision of light to the house in a novel and attractive fashion.

Figure 5:
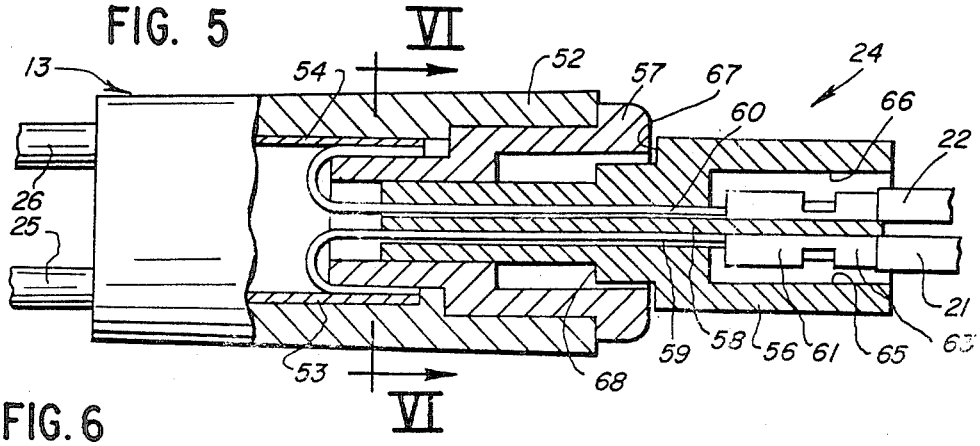
FIG. 5 is a sectional view taken substantially along line V—V of FIG. 2, illustrating the connection between the connector of the invention and a light socket.
Figure 6:
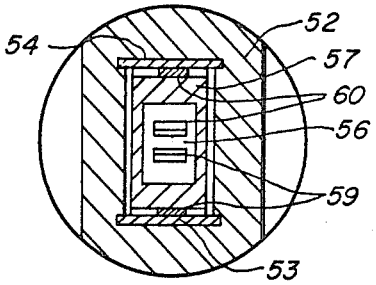
FIG. 6 is a sectional view taken substantially along line VI—VI of FIG. 5.

FIGS. 5 and 6 show the construction of the connector unit 24 and its relationship to the socket 13. The socket 13 has a conventional construction, and it includes a hollow housing 52 of insulating material with a pair of contacts 53 and 54 mounted therein at diametrically opposed positions, such contacts being connected to the conductors 25 and 26 of the string 17. The illustrated connector unit 24 includes a support member 56 of insulating material on which a base member 57 is mounted, the illustrated base member 57 having a construction like that of the lamp of base member 32 of the assembly at the opposite end of the connector 15. The support member 56 has two parallel longitudinally extending openings therethrough, separated by a wall portion 58 and arranged to receive a pair of contact blades 59 and 60. At one end, the blades 59 and 60 are secured to stripped ends of the conductors 21 and 22. At the opposite end, the blades 59 and 60 are bent back around the outside of the base member 57 for engagement with the contacts 53 and 54 of the socket 13.

Figure 7:
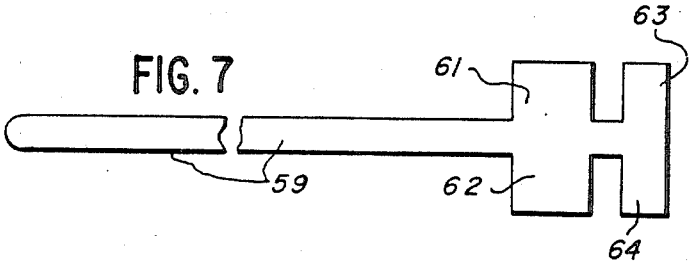
FIG. 7 is a plan view of one of two blades of the connection shown in FIGS. 5 and 6.
Figure 8:
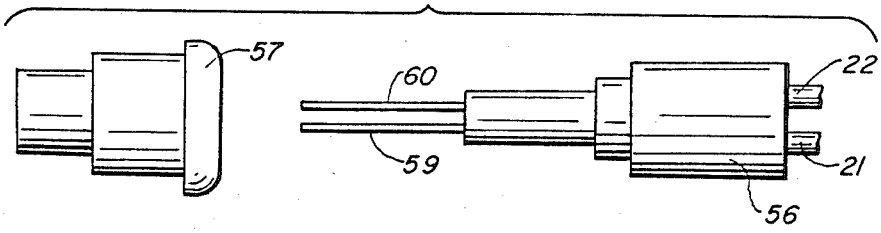
FIG. 8 is an exploded view illustrating a base member and a plug assembly of the connection shown in FIGS. 5 and 6, prior to assembly thereof.
Figure 9:
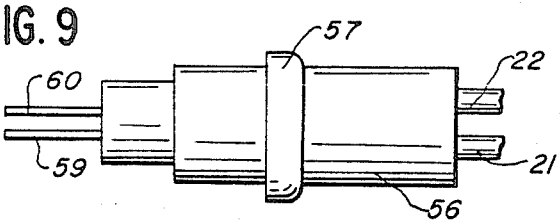
FIG. 9 is a view illustrating the components of FIG. 8 at an intermediate point in the assembly thereof.
Figure 10:
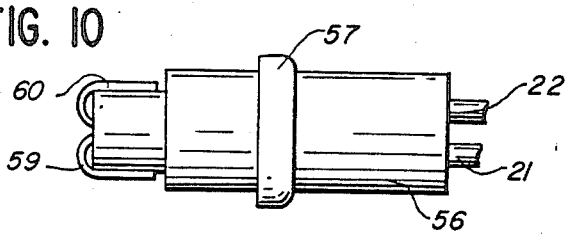
FIG. 10 illustrates the components of FIG. 8 after assembly.

FIG. 7 is a plan view of the blade 59, before assembly, it being understood that the blade 60 has the same construction. Blade 59 has a first pair of ears 61 and 62 and a second pair of ears 63 and 64 projecting transversely therefrom, arranged to be crimped around the stripped end of the conductor 21 prior to assembly. After securing both blades to the conductors 21 and 22, they may be inserted into the support member 56 with the opposite ends of the blades 59 and 60 projecting therefrom, as shown in FIG. 8. Then the assembly may be inserted into the base member 57 to cause the ends of the blades 59 and 60 to project therefrom, as shown in FIG. 9. Then the blades may be bent back around the outside of the base member 57, as shown in FIG. 10.

The end of the support member 56 which is inserted into the base member 57 has a reduced diameter to permit such insertion, the opposite end being of larger diameter to allow for larger internal spaces 65 and 66 which accommodate the connections between the blades and the conductors 25 and 26 and also to provide a shoulder 67 which may abut the end of the base member 57. Also, a stepped configuration is preferably provided with a second shoulder 68 spaced from the shoulder 67. This arrangement provides for a reasonably close fit between the support member 56 and the outer end of the base member 57. At the same time, it allows for the use of the assembly for smaller sizes of lamps.

Figure 11:
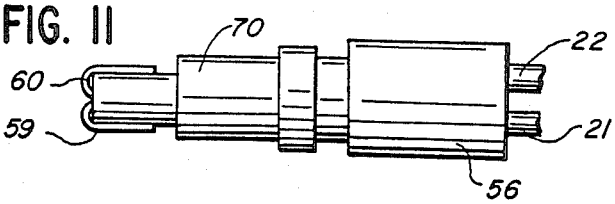
FIG. 11 illustrates an assembly of the plug assembly of the connector and a base member of smaller size than that illustrated in FIGS. 5, 6 and 8–10.

FIG. 11 shows the plug assembly of the connector unit 24 installed in a base member 69 of smaller size than that illustrated in FIGS. 5, 6 and 8–10, for use when the sockets of the string are designed for smaller types of lamps. To accommodate the vast majority of commonly used types and sizes of lamps, the terminal section of the support member 56, between the shoulder 68 and the terminal end of the member 56, preferably has a diameter of on the order of 0.15 inches and a length of on the order of 0.185 inches. The intermediate section between the shoulders 67 and 68 preferably has a diameter of on the order of 0.205 inches and a length of on the order of 0.1 inches. The blades 59 and 60 preferably have a thickness of on the order of 0.01 inches and may, for example, be of 7030 brass (soft to quarter hard).

It will be understood that modifications and variations may be effected without departing from the spirit and scope of the novel concepts of this invention.

We claim:

1. In combination:

a decorative ornament with an aperture therein for receiving an electrical lamp;

a connector cable assembly for electrical connection of said decorative ornament to a string of conventional sockets for miniature Christmas lights or the like, the connector cable assembly having means at one end adapted for electrically mating with a selected one of said sockets and having an electrical socket at an opposite end adapted to receive a miniature light; and coupling means for coupling said socket of said assembly to said ornament aperture comprising a hollow cylindrical outer portion for receiving and holding the connector socket and a hollow cylindrical inner portion for extending axially beyond one end of said outer portion and receiving said miniature light, said inner portion being adapted to mate with said ornament aperture and to hold said miniature light secured in said aperture, said coupling means being constructed of a heat conductive material.

2. The combination of claim 1 wherein said heat conductive material is brass.

3. In combination:

a decorative ornament with an aperture therein for receiving an electrical lamp;

a connector cable assembly for electrical connection of said decorative ornament to a string of conventional sockets for miniature Christmas lights or the like, the connector assembly having means at one end adapted for electritrically mating with a selected one of said sockets and having an electrical socket at an opposite end adapted to receive a miniature light; and coupling means for coupling said socket of said assembly to said ornament aperture comprising a hollow cylindrical outer portion for receiving and holding the connector socket and a hollow cylindrical inner portion for receiving said miniature light, said inner portion being adapted to mate with said ornament aperture and to hold said miniature light secured in said aperture, wherein said coupling means outer portion has a cylindrical outer wall and one end open to receive the connector socket, said outer wall having a plurality of slots therein extending parallel to the axis of the cylindrical outer portion and opening to said open end so as to allow resilient flexure of said outer wall to accept and retain the connector socket.

4. The combination of claim 3 wherein said slots in the outer portion wall extend only partially along said wall and wherein the remaining axial portion of said wall is solid to provide a rigid cylindrical clamping area for said connector socket.

5. The combination of claim 1 wherein said coupling means inner portion has a cylindrical wall of a smaller diameter than said outer portion and has an outwardly extending shoulder about its periphery spaced from said outer portion so as to define an area of reduced diameter adjacent said outer portion that is adapted to fit snugly within said ornament aperture.

6. The combination of claim 5 wherein said inner portion cylindrical wall has slots therein extending parallel to the axis of said inner portion so as to define discrete wall sections that flex inward as said coupling means is inserted into said ornament aperture.

7. The combination of claim 1 wherein said decorative ornament comprises a dome-shaped crown element with said ornament aperture formed therein and a decorative body portion operatively associated with said crown element so as to be illuminated by said miniature light.

8. The combination according to claim 7 wherein said body portion is a solid planar piece of clear, hard material having portions which are etched to diffusely radiate light passing through said material from the edge thereof, said crown element being coupled to the edge of said body portion so as to allow light from said lamp to illuminate said etched portions.

9. The combination of claim 7 wherein said crown element is formed of heat conductive metal and is mechanically mated to said coupling means so as to provide additional heat dissipation from the lamp.

10. A coupling element for attaching a conventional miniature Christmas light and its socket to a tree ornament which has an aperture for receiving said light, said coupling element comprising:

a hollow outer portion having a generally cylindrical shape having a first end open to receive the light socket; and a hollow inner portion coupled to and coaxial with said outer portion and extending axially beyond one end of said outer portion, said hollow inner portion having a generally cylindrical shape and being sized to surround the miniature light itself, said hollow inner portion having means for securely engaging said tree ornament aperture as it is inserted therein, and said element being of a metal material with a high heat conductivity.

11. An ornament coupling element for attaching a conventional miniature Christmas light and its socket to a tree ornament which has an aperture for receiving said light, said coupling element comprising:

a hollow outer portion having a generally cylindrical shape having a first end open to receive the light socket; and a hollow inner portion coupled to and coaxial with said outer portion and having a generally cylindrical shape which is sized to surround the miniature light itself, said hollow inner portion having means for securely engaging said tree ornament aperture as it is inserted therein, wherein said outer portion has a peripheral cylindrical wall with slots formed therein which extend parallel to the axis of said element and are open to said open end of the cylindrical wall, said slots defining a plurality of resilient wall portions that flex outward to receive and engage the light socket as it is inserted into the open end of said outer portion.

12. An ornament coupling element according to claim 10 wherein said inner portion has a generally cylindrical sidewall with slots formed therein that extend parallel to the axis of the element, said slots defining a plurality of wall sections adapted to flex inwardly to facilitate a compressive fit of said inner portion within said ornament aperture.

13. An ornament coupling element according to claim 12 wherein said inner portion is of a smaller diameter than said outer portion and has an outwardly projecting shoulder disposed around its periphery and spaced from the outer portion so as to define an area of reduced diameter adjacent said outer portion that is adapted to snugly fit within said ornament aperture.

14. An illuminated ornament for Christmas trees or the like comprising:

a plate-like element of clear transparent material having portions thereof which are etched to randomly disperse light entering the edge of said element;

an electrical light source; and means for coupling said light source to the edge of said plate-like element so as to effect illumination of the etched portions thereof, said ornament further including a flexible connector cable having one end electrically coupled to said light source and the other end adapted for electrical insertion into one socket of a conventional miniature tree light set.

* * * * *